United States Patent [19]

Hanson

[11] 4,086,673

[45] May 2, 1978

[54] ARTICULATED BED

[76] Inventor: Paul B. Hanson, 2761 Eastwood Dr., Decatur, Ga. 30032

[21] Appl. No.: 702,022

[22] Filed: Jul. 2, 1976

Related U.S. Application Data

[63] Continuation of Ser. No. 533,980, Dec. 18, 1974, Pat. No. 3,991,428.

[51] Int. Cl.[2] ..... A61G 7/10

[52] U.S. Cl. ..... 5/92; 5/63; 5/345 R

[58] Field of Search ..... 5/63, 66, 90, 92, 338, 5/345 R, 352

[56] References Cited

U.S. PATENT DOCUMENTS

| | | | |
|---|---|---|---|
| 1,274,851 | 8/1918 | Byrd | 5/65 |
| 1,351,166 | 8/1920 | Gundlach | 5/357 |
| 1,372,802 | 3/1921 | Davis | 5/65 |
| 3,611,453 | 10/1971 | Lokken | 5/63 |
| 3,855,652 | 12/1974 | Nicholson | 5/345 R |
| 3,991,428 | 11/1976 | Hanson | 5/63 |

*Primary Examiner*—Casmir A. Nunberg
*Attorney, Agent, or Firm*—Newton, Hopkins & Ormsby

[57] ABSTRACT

An articulated bed is disclosed comprising a main frame, an auxiliary frame, and means for adjusting the height of the auxiliary frame relative to the height of the main frame. An auxiliary mattress is supported by the auxiliary frame and a main mattress is supported by the main frame circumferentially about at least a portion of the auxiliary mattress.

1 Claim, 6 Drawing Figures

ARTICULATED BED

CROSS REFERENCE TO RELATED APPLICATIONS

This is a continuation of my copending application Ser. No. 533,980 filed Dec. 18, 1974 now U.S. Pat. No. 3,991,428, which was a continuation of Ser. No. 406,567 filed Oct. 15, 1973 now abandoned.

BACKGROUND OF THE INVENTION

This invention relates generally to articulated beds, and in particularly to articulated beds of the type which may be adjusted to facilitate sexual intercourse between two people supported upon the bed.

U.S. PAT. NOS.

1,351,166; 1,274,851; 1,372,802; 3,611,453; 3,503,084

UNITED KINGDOM PAT. NO.

7871, 1913

Accordingly, it is a general object of the present invention to provide an articulated bed.

More specifically, it is an object of the invention to provide an articulated bed having a plurality of components the relative heights of which may be adjusted to facilitate sexual intercourse between two people supported upon the bed.

Another object of the present invention is to provide an Articulated Bed having a plurality of components, the relative height of which may be adjusted to facilitate sexual intercourse, in which the parts of the bed may be readily and easily replaced.

SUMMARY OF THE INVENTION

In one form of the invention an articulated bed is provided comprising a main frame, an auxiliary frame, and means for adjusting the height of the auxiliary frame relative to the height of the main frame. An auxiliary mattress is supported by the auxiliary frame. A main mattress is supported by the main frame circumferentially about at least a portion of the auxiliary mattress.

DETAILED DESCRIPTION OF THE DRAWING

Figure 1:
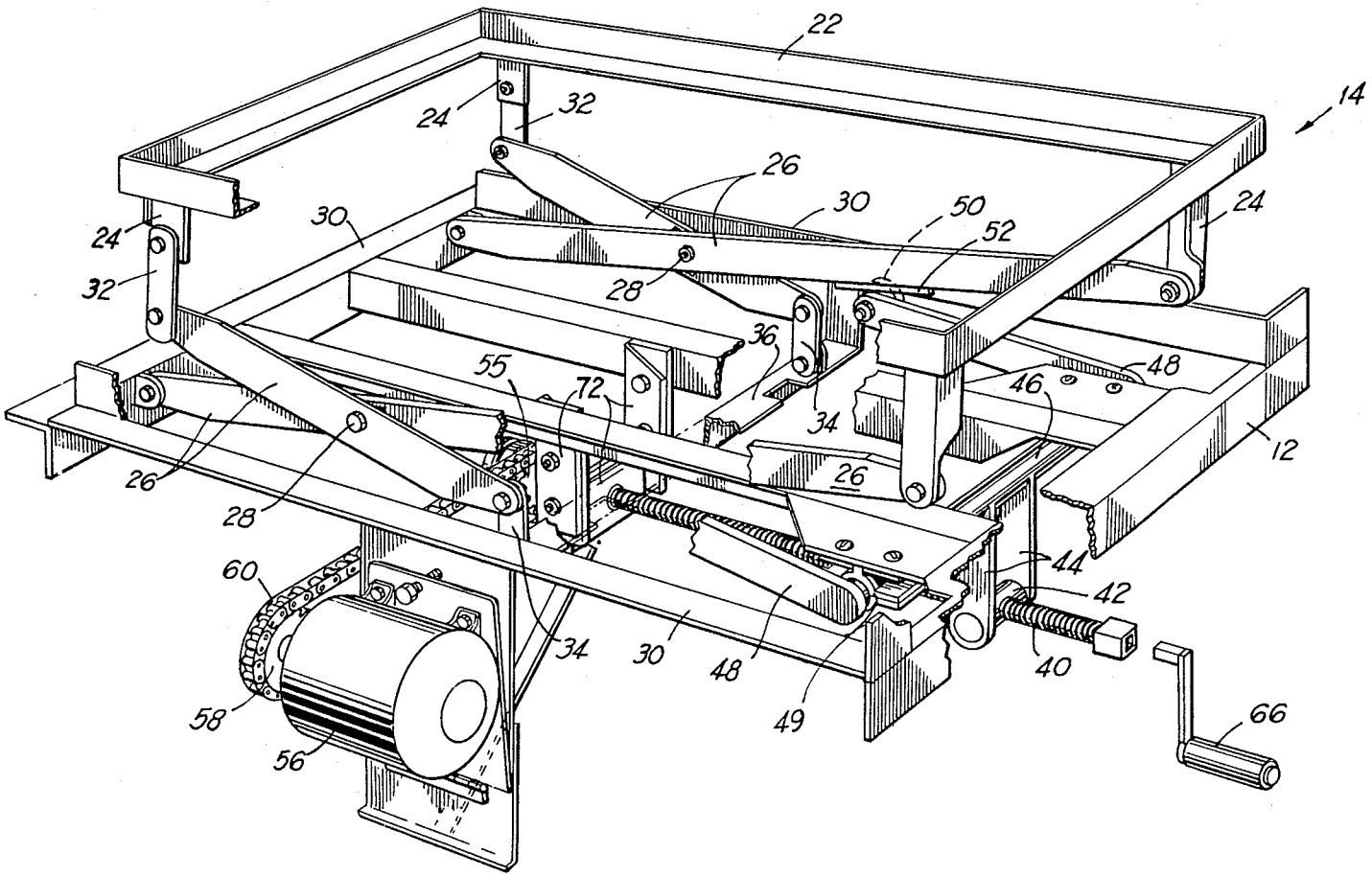
FIG. 1 is a perspective view of an auxiliary frame and means for adjusting the height of the auxiliary frame which frame and height adjusting means provide components of an articulated bed embodying principles of the present invention in one form.
Figure 2:
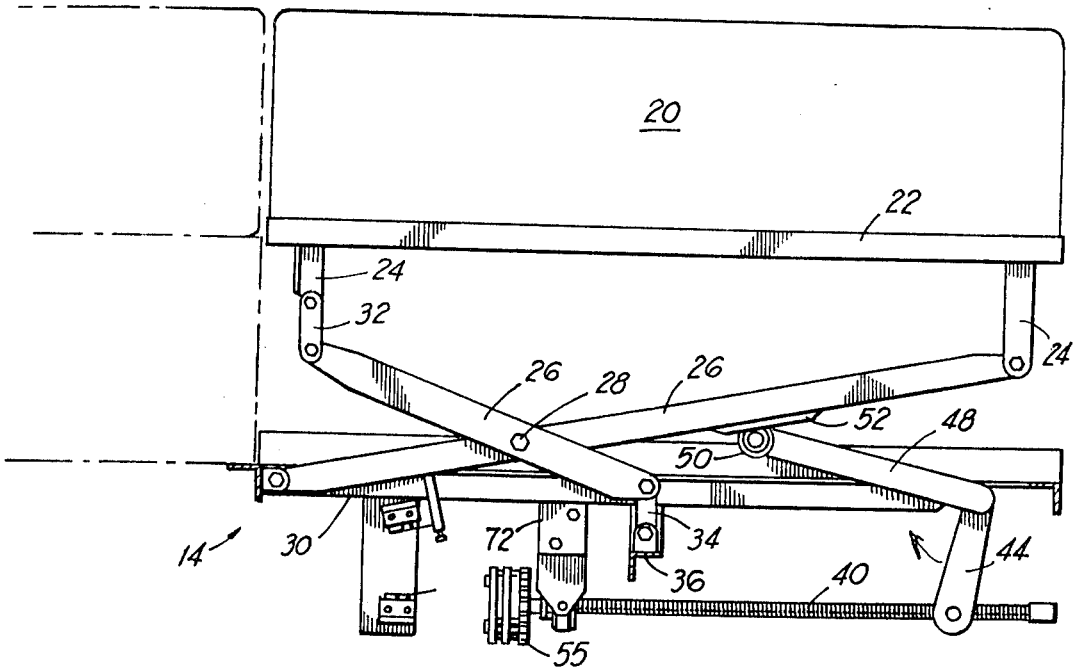
FIG. 2 is a side view in elevation of the auxiliary frame shown in FIG. 1 in a raised position together with an auxiliary mattress supported thereon.
Figure 3:
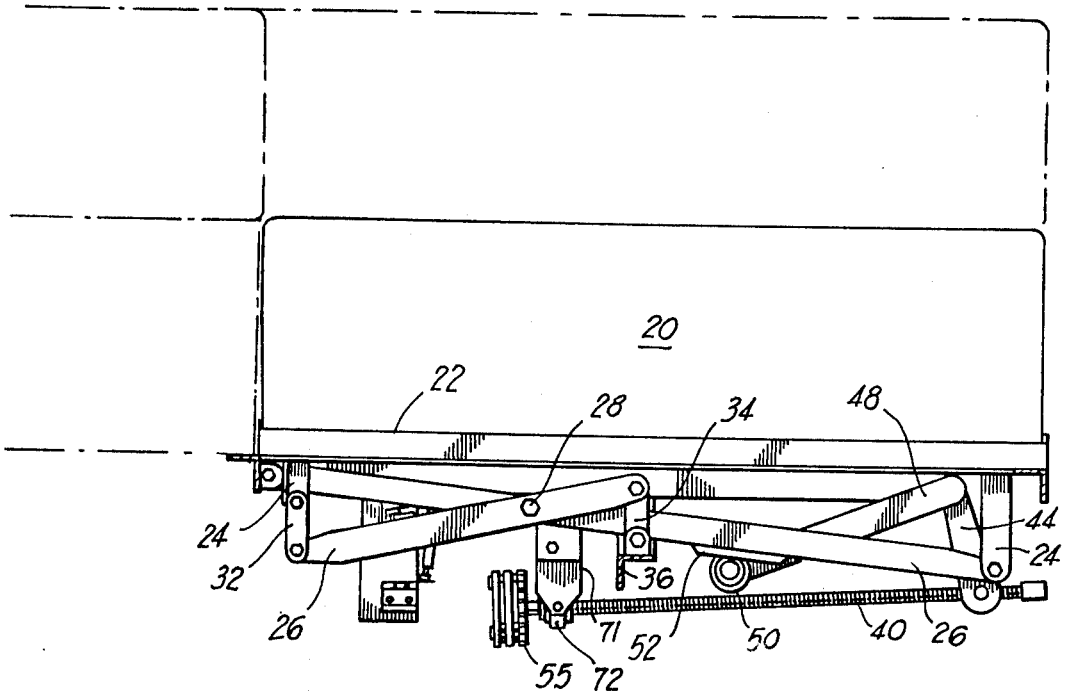
FIG. 3 is a side view in elevation of the auxiliary frame shown in FIG. 1 in a lowered position together with an auxiliary mattress supported thereon.

Referring now in more detail to the drawing there is shown an articulated bed 10 embodying principles of the present invention in one preferred form. The bed includes a main frame 12 and an auxiliary frame 14. The main frame supports a generally U-shaped set of box springs 16 which in turn supports a generally U-shaped mattress 18. The auxiliary frame supports a rectangular auxiliary mattress 20 within a recess in one end of the box springs and main mattress.

With particular reference to FIG. 1 the auxiliary frame is seen to comprise a rectangular upper mattress support assembly of angle irons 22 from the four corners of which four support posts 24 project downwardly. Two pairs of crossed legs 26 are pivoted together by pins 28. One end of a leg in each pair of crossed legs is pivotally mounted to a support post 24 with the other end pivotally mounted to a rectangular lower mattress support assembly 30 disposed beneath upper support assembly 22. The other leg of each pair of crossed legs is pivotally mounted to a link 32 at one end with the other end pivotally mounted to a link 34. Links 34 are in turn pivotally mounted to a transversed angle iron 36 rigidly secured to a lower mattress support 30 while links 32 are pivotally mounted to posts 24.

A threaded rod 40 is rotatably journalled through a pivotable bearing supported between parallel pendants 72 and through a threaded bore in a rod 42 spanning the lower ends of parallel pendants 44 which depend from a transverse, rotatable bar 46 rigidly joined to an actuating arm 48 through fixed bearings 49. Rollers 50 are rotatably supported on the distal end of the actuating arms. These rollers rotatably engage a track 52 secured to the bottom of one arm in each of the pairs of crossed arms 26.

To the end of threaded rod 40 is rigidly secured a sprocket 55. An electric motor 56 having a sprocket 58 rigidly secured to the output shaft of the motor is mounted to frame 30. A chain 60 couples sprockets 55 and 58 together. The electric motor may be energized by connection to a source of electric current by unshown cord means. The electric motor is of the reversible type controlled by means of a switch 62 mounted to a headboard 64 and electrically coupled by lines 66 to the motor. When energized, the electric motor drives chain 60 in either direction causing threaded rod 40 to rotate. As an alternative drive means a crank handle or ratchet 66 may be employed by insertion into an accessible end of rod 40. When rod 40 is rotated, whether by manual or electric power means, pendants 44 are driven thereby up or down the rod. This movement in turn causes rollers 50 to follow an arcuate path about bearing 49 beneath arms 26 forcing them in turn to pivot. This pivotal movement by one arm 26 in each of the two pairs of crossed arms causes the pairs of arms to effect a scissor-like action thereby raising or lowering the upper mattress support assembly 22 along a substantially vertical path.

Figure 4:
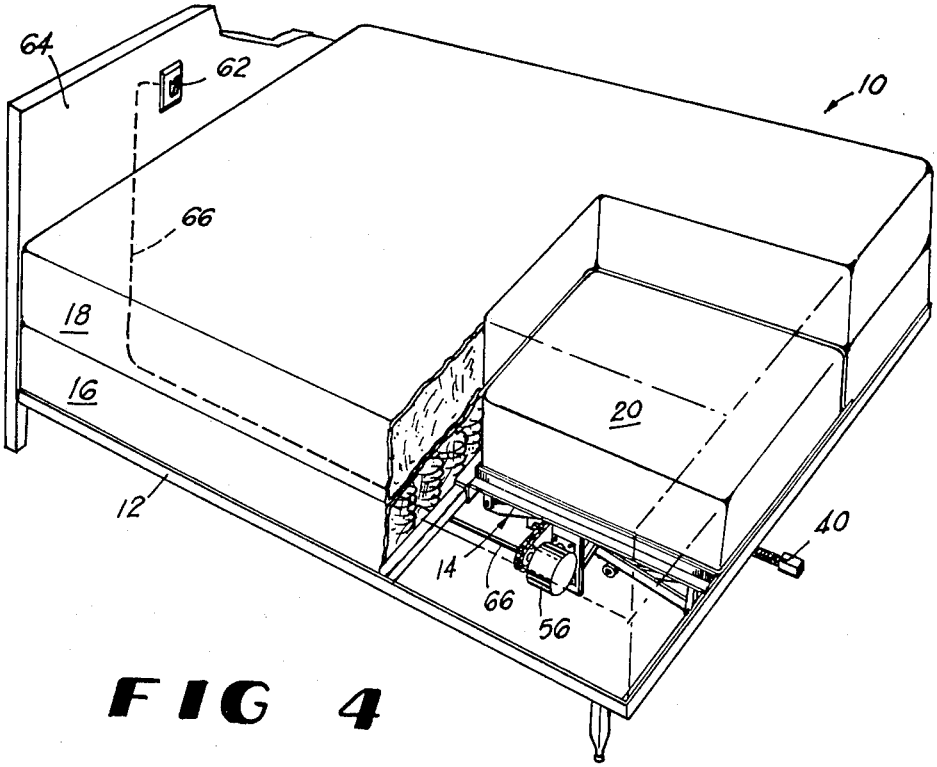
FIG. 4 is a perspective view of an articulated bed embodying principles of the present invention which bed includes the auxiliary frame and auxiliary mattress shown in FIGS. 2 and 3 with the auxiliary mattress positioned in a lowered position relative to the main frame mattress.
Figure 5:
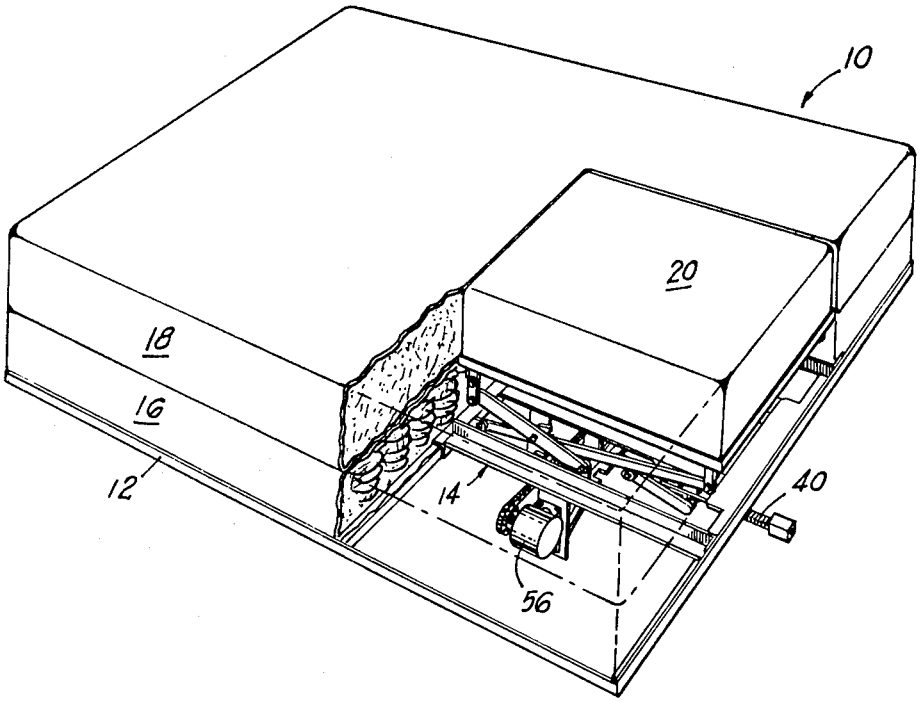
FIG. 5 is an elevational view of the articulated bed shown in FIG. 4 with the auxiliary mattress positioned in a raised position relative to the main frame mattress.

In FIGS. 4 and 5 the articulated bed is seen to have a generally U-shaped mattress 18 defining a recess in which a generally rectangular auxiliary mattress 20 resides. This auxiliary mattress can be elevated to a point where its upper surface is substantially coplanar with the upper surface of the main mattress. By energizing the drive motor or by manually rotating the hand crank the position of the upper surface of the auxiliary mattress may be raised or lowered between the positions shown in FIGS. 4 and 5. The lowered position enables a couple to have sexual intercourse with facility by enabling the female to recline upon the main mattress with her legs straddling the auxiliary mattress and by enabling the male partner to kneel upon the auxiliary mattress. At other times the auxiliary mattress may be raised to the position shown in FIG. 5 where the entire support surface of two mattresses is substantially coplanar in conventional fashion.

Figure 6:
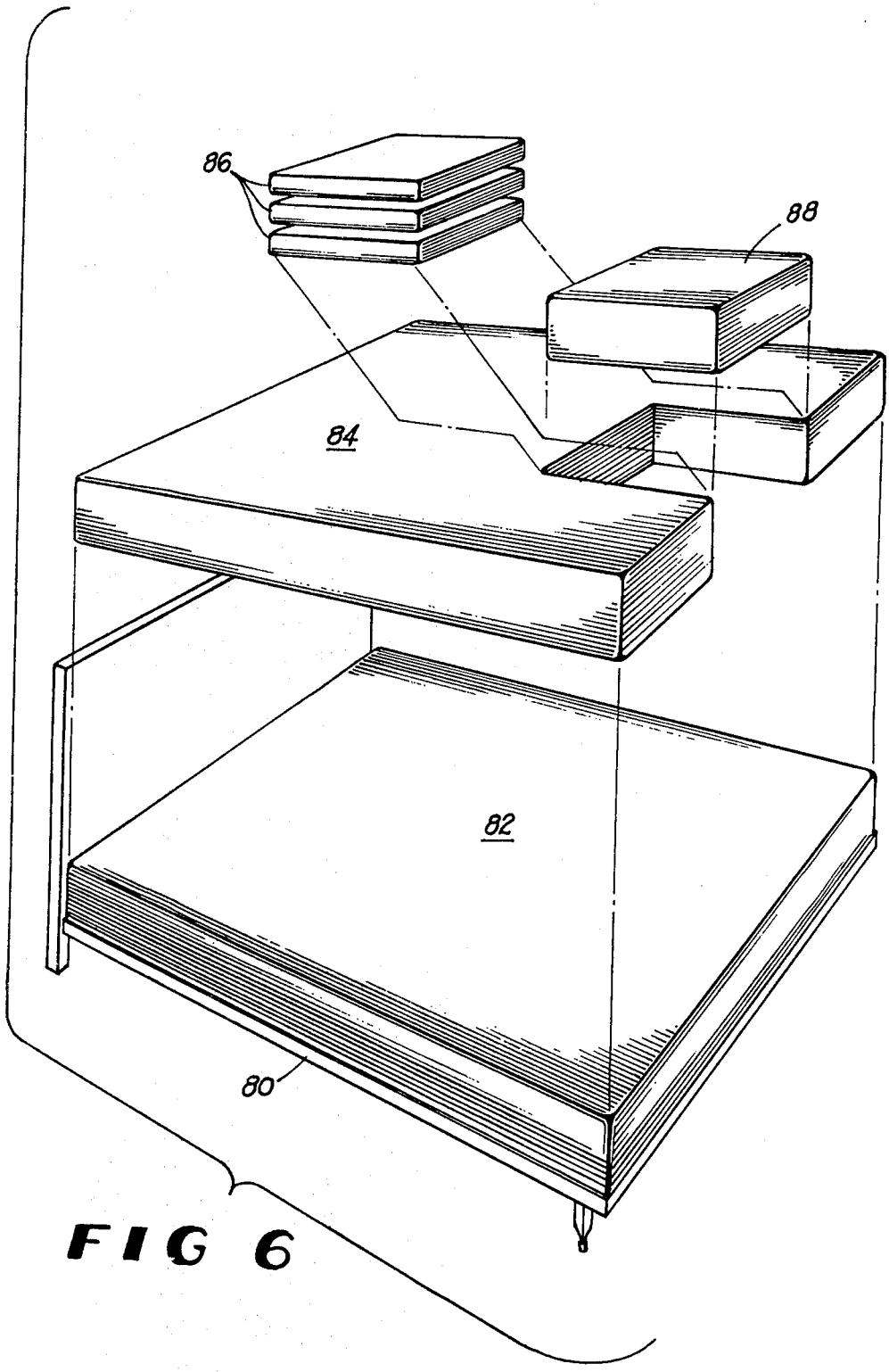
FIG. 6 is an exploded view in perspective of an articulated bed embodying principles of the invention in another form.

FIG. 6 illustrates an articulated bed embodying the invention in another form. Here the bed is seen to include a frame 80 supporting a rectangular mattress support 82 upon which is set a U-shaped main mattress 84 having a recess in one end thereof into which a set of height-adjusting pads 86 or an auxiliary mattress 88 may be manually inserted. For sleeping the auxiliary mattress is positioned within the recess. For sexual intercourse the auxiliary mattress is removed and, if desired, one or more pads substitute therefore for male height adjusting purposes.

It should, of course, be understood that the just described embodiment merely illustrates principles of the invention in one form. Many modifications may be made to the illustrative embodiment without departure from the spirit and scope of the invention as set forth in the following claims.

What is claimed is:

1. An articulated bed comprising:

(a) a main rectangular box spring mattress support having a flat continuous horizontal upper surface;

(b) a flat horizontal U-shaped main mattress defining a central recess in one end thereof;

(c) removable mattress means received within and filling said recess, said removable mattress means having an upper surface coplanar with the upper surface of said main mattress and being removable from said recess to facilitate use of the main mattress and the recess for sexual intercourse, said removable mattress including a plurality of mattresses stacked vertically one on the other, within said recess, said removable mattresses being respectively individually removable to vary the effective height of the upper most surface of the remaining removable mattress, said removable mattress being supported on the upper surface of said mattress support.

* * * * *